US006201518B1

(12) United States Patent
Kane et al.

(10) Patent No.: US 6,201,518 B1
(45) Date of Patent: Mar. 13, 2001

(54) CONTINUOUS DRIVE AC PLASMA DISPLAY DEVICE

(75) Inventors: Michael Gillis Kane, Skillman; William Ronald Roach, Rocky Hill, both of NJ (US)

(73) Assignee: Sarnoff Corporation, Princeton, NJ (US)

( * ) Notice: Subject to any disclaimer, the term of this patent is extended or adjusted under 35 U.S.C. 154(b) by 0 days.

(21) Appl. No.: 09/144,242

(22) Filed: Aug. 31, 1998

Related U.S. Application Data

(60) Provisional application No. 60/084,997, filed on May 11, 1998, and provisional application No. 60/060,119, filed on Sep. 26, 1997.

(51) Int. Cl.[7] ..... G09G 3/28

(52) U.S. Cl. ..... 345/60; 345/61; 345/67; 345/68

(58) Field of Search ..... 345/60, 61, 208, 345/209, 67, 68

(56) References Cited

U.S. PATENT DOCUMENTS 3,761,773 * 9/1973 Johnson et al. ..... 345/68

6,104,361 * 8/2000 Rutherford ..... 345/60

* cited by examiner

*Primary Examiner*—Richard A. Hjerpe
*Assistant Examiner*—Benjamin D. Bowers
(74) *Attorney, Agent, or Firm*—William J. Burke

(57) ABSTRACT

A plasma display device having three-electrode pixels. Each pixel may be set either in a write state or in a sustain state by a pair of select electrodes. In the write state the pixel may be set either ON or OFF. A pixel is put in a write state when the AC signals applied to the select electrodes are in phase. Once the signals applied to the select electrodes are in phase, the pixel may be set ON or OFF depending on the phase of the signal applied to a data electrode. In the sustain state the pixel remains either ON or OFF regardless of the signal applied to the data electrode. A pixel is put in a sustain state when out-of-phase signals are applied to the pair of select electrodes. The pixels in the display are arranged in rows and columns. Each pixel column has a single data electrode, and each pixel row has a pair of select electrodes associated with it. Pixels in unselected rows may be illuminated concurrently with the writing into pixels in selected rows. In order to avoid crosstalk and high electric fields generated between a select electrode of one pixel and a select electrode of an adjacent pixel, adjacent pixel rows may share a select electrode.

17 Claims, 4 Drawing Sheets

CONTINUOUS DRIVE AC PLASMA DISPLAY DEVICE

This application claims benefit of the filing date of provisional application No. 60/084,997 filed May 11, 1998 and of the filing date of provisional application No. 60/060,119 filed Sep. 26, 1997.

The invention was made under U.S. Government Contract No. DAAL01=96-C-0090.

The U.S. Government has rights in the invention.

TECHNICAL FIELD

The present invention relates generally to a Plasma Display Panel (PDP) and method of operating the display panel. More specifically, the present invention is related to a continuous-drive high-frequency AC Plasma Display Panel and a method of addressing the display panel.

BACKGROUND OF THE INVENTION

Plasma Display Panels (PDPs) offer promising technology for implementing large, flat video screens. A typical PDP may be formed by enclosing a gas, for example, a mixture of helium and neon between a transparent front panel and a back panel. Electrodes may be routed on the front panel and on the back panel and phosphors may be printed on either the front panel or the back panel. The electrodes are used to ionize the gas, forming a plasma which emits ultraviolet radiation. The ultraviolet radiation, in turn, causes the phosphors to emit visible light. Color displays are made by forming adjacent columns having red, green and blue phosphors, respectively.

A common type of PDP is the three-electrode pulsed Alternating Current (AC) device. In this configuration, each display row includes two parallel row electrodes, for example, on the inside surface of the back panel and each column includes one column electrode, for example, on the inside surface of the front panel. The row electrodes on the back panel may be covered with a dielectric layer so that no direct current (DC) flows between the electrodes when the plasma is ignited. The electrodes on the front panel may also be covered with a dielectric layer.

In order to generate gray-scale values, each field interval of a video image may be divided into multiple sub-field intervals. Each sub-field interval includes a writing phase and an illumination phase. The illumination phases of the different sub-fields of an image field have respective durations. These durations are programmed such that each individual pixel position on the screen may be illuminated for an amount of time proportional to the binary value of an image picture element.

Briefly, an AC plasma display operates as follows. Operation is divided into two phases or states, the writing phase (writing state) and the illumination phase (sustain state). In the writing phase of a given sub-field, data values are written into each pixel position of the display device one row at a time. The rows are selected one at a time by successively applying a select potential to each row. At the same time, voltages are applied to the column electrodes to establish a relatively high potential between the column electrodes and the selected row electrode for pixels that are to be illuminated during the sustain state of the sub-field interval, and to establish a relatively low potential between the column electrodes and the selected row electrode for pixels that are not to be illuminated during the sustain state. The relatively high potential causes an electric charge to be deposited between the front and back panels, on the inside walls of the dielectric layers, at the respective pixel position. This electric charge is commonly known as a "wall charge."

In other words, a pixel which will be bright has a wall charge written into it, and thus receives "ON" data. A pixel which will be dark does not have a wall charge written into it, and thus receives "OFF" data. In some implementations, the writing phase includes a preliminary erase step in which wall charges from the previous frame of data are erased.

After the wall charge has been written for each row of the display, the sustain state of the sub-field begins. During the sustain state a predetermined potential is applied in pulses between the two parallel row electrodes across the entire display. If a pixel position has a wall charge ("ON" data), the predetermined potential ignites the plasma at that pixel position. If the pixel position does not have a wall charge ("OFF" data), the plasma does not ignite.

In conventional PDPs, illumination is prohibited in the writing phase while rows are being written. If illumination is attempted while rows are being written, crosstalk may occur as data voltages on the column electrodes may interfere with the discharge in unselected rows. Thus the display may be relatively dimmer because it is not illuminated while data values are written into the display. In some conventional displays, about 50% of the display time is taken up by the writing phase.

Further, in conventional PDPs, alternating pulses are applied to row electrodes during the illumination phase. Hence, the display generates light as narrow impulses at pulse edges, and each light impulse is allowed to decay fully in order to completely invert the wall charge in preparation for the next pulse. Therefore, the display is dimmer than it would be if light were generated continuously.

Moreover, in a conventional PDP, the use of pulses to write and illuminate the display causes the driver electronics to dissipatively charge and discharge the column and row electrodes. Hence, the power dissipation in conventional PDPs is inefficient.

SUMMARY OF THE INVENTION

The present invention is embodied in a plasma display apparatus having a plurality of pixels. Each pixel has an ON state and an OFF state. Each pixel of the display apparatus comprises: a top substrate; a bottom substrate disposed parallel to the top substrate; a first select electrode provided on one of the top substrate and the bottom substrate; a second select electrode, adjacent to the first select electrode, provided on the same substrate; a data electrode provided on the opposite substrate. A signal source supplies an AC signal having either a first phase or a second phase.

A first switch is connected to the AC signal source and to the first select electrode to selectively apply the first phase or the second phase of the AC signal source to the first select electrode. A second switch is connected to the AC signal source and to the second select electrode to selectively apply the first phase or the second phase of the AC signal source to the second select electrode. A third switch is connected to the AC signal source and to the data electrode to selectively apply the first phase or the second phase of the AC signal source to the data electrode.

When the same phase is applied to both the first and second select electrodes, the phase of the AC signal source applied to the data electrode determines the state of the pixel; and when the phase applied to the first select electrode differs from the phase applied to the second select electrode, the state of the pixel remains unchanged.

According to one aspect of the invention, each pixel of the plurality of pixels further comprises a gas capsule, formed by a transparent tube or a transparent sphere, interposed between the top substrate and the bottom substrate and aligned with the first select electrode and the second select electrode.

According to another aspect of the invention, a first dielectric layer is formed on the top substrate, and a second, thicker, dielectric layer is formed on the bottom substrate.

According to yet another aspect of the invention, select electrodes are shared between pixels, so that the second select electrode of one pixel is the first select electrode of another successive pixel.

According to another aspect of the invention, an ON state is written to a selected pixel of the plurality of pixels by applying the second phase to the data electrode if the first phase is applied to both the first select electrode and the second select electrode. An ON state is also written to a selected pixel by applying the first phase to the data electrode if the second phase is applied to both the first select electrode and the second select electrode. An OFF state is written to the selected pixel by applying the first phase to the data electrode if the first phase is applied to both the first select electrode and the second select electrode. An OFF state is also written to the selected pixel by applying the second phase to the data electrode if the second phase is applied to both the first select electrode and the second select electrode.

According to yet another aspect of the invention, a signal source supplies an AC signal having either a reference phase or a complementary phase. Each pixel of the display apparatus comprises: a top substrate; a bottom substrate disposed parallel to the top substrate; a reference electrode, provided on one of the top and the bottom substrate, receiving the reference phase of the AC signal; a select electrode, adjacent to the reference electrode, provided on the same substrate; a data electrode provided on the opposite substrate.

A first switch is connected to the AC signal source and to the select electrode to selectively apply the reference phase or the complementary phase of the AC signal to the select electrode. A second switch is connected to the AC signal source and to the data electrode to selectively apply the reference phase or the complementary phase of the AC signal to the data electrode.

When the reference phase is applied to the select electrode the pixel is set to the ON state if the complementary phase is applied to the data electrode, and the pixel is set to the OFF state if the reference phase is applied to the data electrode. When the complementary phase is applied to the select electrode the state of the pixel remains unchanged.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures:

FIG. 7(*b*) is an equivalent circuit diagram to the circuit diagram shown in FIG. 7(*a*).

DETAILED DESCRIPTION OF THE INVENTION

Figure 1:
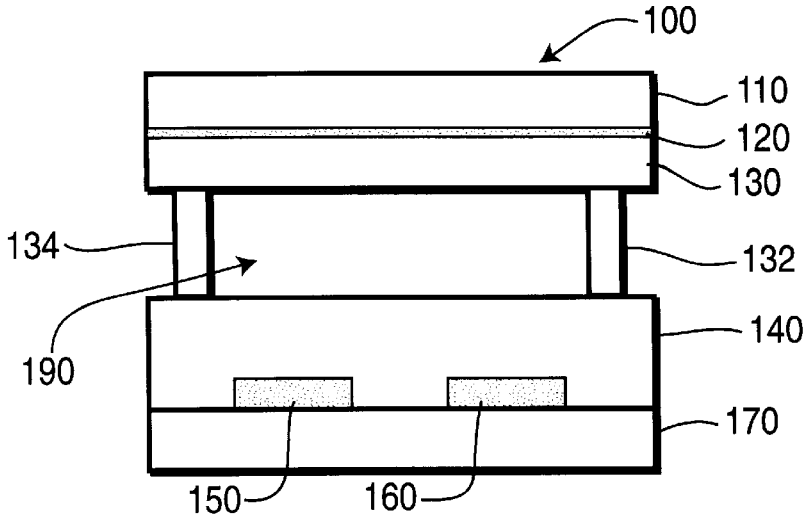
FIG. 1 is a cross-section diagram illustrating the structure of a pixel in a plasma display panel.
Figure 2A:
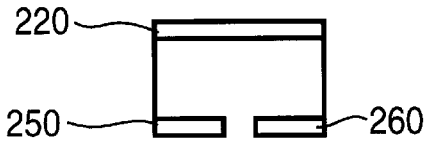
FIGS. 2(*a*)–2(*d*) illustrates four possible states of a pixel in accordance with an embodiment of the present invention.
Figure 2B:
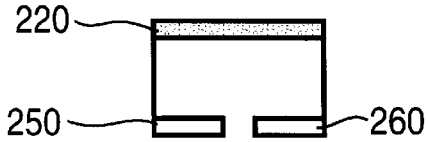
Figure 2C:
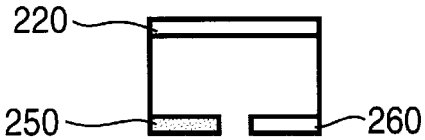
Figure 2D:
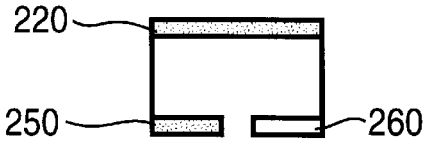

FIG. 1 is a cross-section diagram illustrating the structure of pixel 100 in a plasma display panel. Pixel 100 includes: top substrate 110; bottom substrate 170, held parallel to top substrate 110 by support posts 132 and 134; data (column) electrode 120, provided on top substrate 110; dielectric layer 130, coating data electrode 120; first select (row) electrode 150, provided on bottom substrate 170; second select (row) electrode 160, provided on bottom substrate 170 adjacent to first select electrode 150; and dielectric layer 140, covering bottom substrate 170 as well as select electrodes 150 and 160.

Top substrate 110 may be formed of a glass like transparent material. Dielectric layer 130 may be formed of glass or other transparent material. Bottom substrate 170 and dielectric layer 140 may be formed glass, ceramic, or other transparent or opaque material. Data electrode 120 and select electrodes 150 and 160, may be formed of a metallic electrically conductive substance or a transparent conductor such as indium-tin oxide (ITO). In inner space 190 of pixel 100, gas, such as, for example, a mixture of Helium and Neon may be confined. The gas occupying inner space 190 may be encapsulated in a glass like tube or sphere (not shown in FIG. 1).

It may be desirable to form dielectric layer 140 thicker than dielectric layer 130. Dielectric layer 140 may be formed as thick as, for example, 10 mils. In this manner, the geometry of pixel 100 assists in positioning gas plasma, in inner space 190, away from fringe fields at the edges of select electrodes 150 and 160. Hence, when an electric field is formed between data electrode 120 and select electrodes 150 and 160, plasma gas may be positioned closer to regions of inner space 190 where the electric field is substantially uniform.

Pixel 100 may further include a source supplying an Alternating Current (AC) signal (not shown in FIG. 1). The AC signal source supplies pixel 100 with at least two AC signals. These signals share the same frequency, for example, 5 MHz, but may have different phases with respect to each other. For example, the signals may have either a reference phase of $\phi=0°$ or a complementary phase of $\bar{\phi}=180°$. Switches (not shown in FIG. 1) may be used to route the signals to data electrode 120 and select electrodes 150 and 160. For example, a 2×1 multiplexer may be used to selectively switch a line connected to data electrode 120 between a (5 MHz) signal at the reference phase of $\phi=0°$ and a (5 MHz) signal at the complementary phase of $\bar{\phi}=180°$. Another 2×1 multiplexer may be used to perform the switching operation for select electrode 150, and yet another 2×1 multiplexer may be used for the switching operation for select electrode 160. DMOS technology may be employed to implement the switching operation described above. In particular, DMOS switches having lightly doped (or extended) drains may be used in order to minimize capacitance and allow for switching between signals having voltage swings of 100–200 Volts at frequencies of up to 10 MHz.

It should be noted that although signals are provided at a common frequency for synchronization purposes, it may be desirable to supply signals at different amplitudes. For example, signals with peak voltage $V_{row}$ (e.g. 55 Volts) may be applied to select electrodes 150 and 160, while a signal with peak voltage $V_{column}$ (e.g. 24 Volts) may be applied to data electrode 120.

FIGS. 2(*a*)–2(*d*) illustrates four possible states of a pixel in accordance with an embodiment of the present invention. FIGS. 2(*a*) and 2(*b*) illustrate write states, while FIGS. 2(*c*) and 2(*d*) show sustain states. In each of FIGS. 2(*a*)–2(*d*) a pixel is represented by data electrode 220, first select electrode 250, and second select electrode 260. The electrodes in FIGS. 2(*a*)–2(*d*) are drawn either shaded or unshaded. An electrode is drawn shaded when an AC signal with a phase of $\overline{\phi}$=180° is applied, and unshaded when an AC signal with a phase of $\phi$=0° is applied. Note that in practice some skewing of phase may occur along conductors. Hence, two signals may be considered, practically, in phase when the difference between the phases is within a is tolerance level (e.g. ±10°). Table 1 summarizes the states of a pixel.

TABLE 1

| | SIGNAL APPLIED TO ELECTRODE | | |
|---|---|---|---|
| STATE | First select electrode | Second select electrode | Data electrode |
| Write OFF | $V_{row}$ at phase $\phi$ | $V_{row}$ at phase $\phi$ | $V_{column}$ at phase $\phi$ |
| Write ON | $V_{row}$ at phase $\phi$ | $V_{row}$ at phase $\phi$ | $V_{column}$ at phase $\overline{\phi}$ |
| Sustain (illuminate) | $V_{row}$ at phase $\phi$ | $V_{row}$ at phase $\overline{\phi}$ | $V_{column}$ (any phase) |

A plasma display panel has multiple pixels, such as pixel 100 of FIG. 1, organized in rows and columns. The first select electrode, and the second select electrode, respectively, may be shared by all pixels in a row. The data electrode may be shared by all pixels in a column. The operation of a display involves writing states and illumination states, as summarized by the table above. Unlike conventional PDPs, rows that are not being written to may be illuminated.

In the writing states, data are written into a selected display row. A display row may be selected by driving both select electrodes with an AC signal having the reference phase $\phi$. OFF data is written into a selected pixel when the data electrode corresponding to the pixel is driven with an AC signal having the same phase $\phi$. In this case, the electric field in the pixel is small, and thus insufficient to initiate a plasma discharge. ON data is written into a selected pixel when the data electrode corresponding to the pixel is driven with an AC signal that is out of phase with the select electrodes, i.e. phase $\overline{\phi}$. When the data electrode is out of phase with the select electrodes, a relatively large, relatively uniform, AC electric field may form across the inner space the pixel, sufficient to ignite the plasma.

Following the writing phase, the plasma that has been initiated in pixels having an ON state in the previously selected row will remain in that state until free electrons and ions in the plasma recombine. Thus, the plasma associated with pixels in the ON state is "primed" and may be sustained by a voltage smaller than that required to initiate the plasma. An ON sustaining voltage may be provided by driving the select electrodes in unselected rows with out-of-phase AC voltages, i.e. phases $\phi$ and $\overline{\phi}$. While the sustaining voltage is sufficient to maintain a pre-existing plasma, it is not sufficient to initiate a plasma. In other words, the sustaining voltage is in the center of the plasma's hysteresis characteristic. Due to the symmetry of the AC waveforms, the magnitude of the fields in pixels of unselected rows does not depend on the data being applied to the columns. Therefore crosstalk is limited, permitting illumination in unselected rows to be concurrent with data writing in selected rows.

It may be desirable to set the AC amplitude applied to a pixel rows, $V_{row}$, to be different from that applied to a pixel columns, $V_{column}$. For example, $V_{row}$ may be set at approximately twice $V_{column}$. It may also be desirable to set the AC amplitude used for selecting a row to be different from that used to sustain pixel states along an unselected row.

Further, as noted above a relatively thick dielectric layer provided on the bottom substrate of a pixel may cover the select electrodes. The dielectric is helpful in differentiating between the electric fields, formed in the inner space of the pixel, during the writing states and during the illumination states. Using this arrangement, the maximum field in the plasma (inner space) for a selected ON pixel may be at least 50% larger than that in a pixel in a sustain state. Thus, it may be ensured that a plasma can be maintained without 'turning ON' pixels that are in the OFF state. At the same time, an ON pixel in an illumination state may have a peak field four times larger than that of a selected OFF pixel, thus ensuring that pixels may be written with OFF data without sustaining residual ON data from a previous frame.

Data and select electrodes of a PDP in accordance with an embodiment of the present invention operate at a common AC frequency. At approximately 5 MHz, for example, little opportunity is given for a wall charge to be written in a single half-cycle, and the symmetry of the AC waveform prevents an accumulation of a wall charge over time. Therefore, it is not necessary to build up a wall charge for the proper functioning of the PDP.

Figure 3:
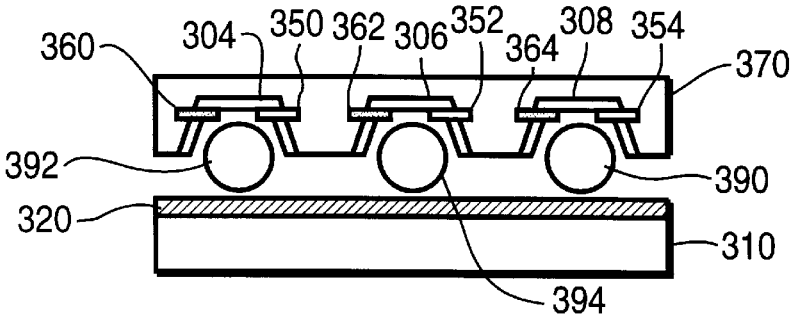
FIG. 3 is a cross-section diagram of the structure of a portion of a pixel column in accordance with an embodiment of the present invention.

FIG. 3 is a cross-section diagram of the structure of a portion of a pixel column in accordance with an embodiment of the present invention. FIG. 3 shows the cross section of three pixel rows having a common data electrode 320, and three sets of select electrodes 350 and 360, 352 and 362, and 354 and 364, respectively. Each pixel includes a plasma gas microcapsule, 392, 394, and 390, respectively. The gas microcapsules are all positioned between the top substrate 310 and bottom substrate 370. Associated with each pixel is a phosphor, 304, 306, and 308, respectively. The phosphors may correspond, for example, to the colors red, green, and blue. In the arrangement of FIG. 3 each pixel is distinctly associated with two select electrodes. To maximize the electric fields within the microcapsules while maintaining an ON, sustain, or OFF state it is desirable that the select electrodes be isolated from one another. High fields, however, may still be generated between a select electrode of one pixel and a select electrode of an adjacent pixel. These fields, are typically present in a region that is outside of the encapsulated plasma, and hence should not interfere with the operation of the display.

Figure 4:
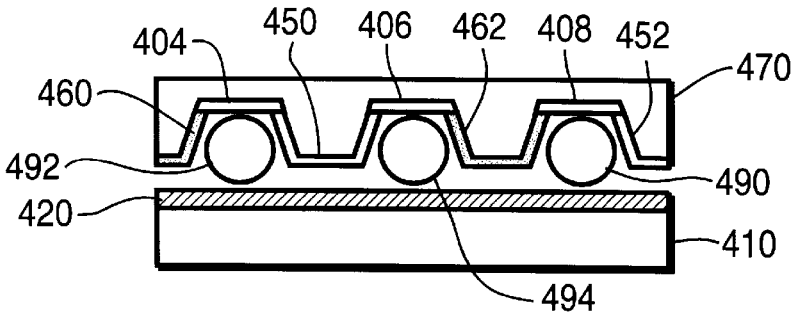
FIG. 4 is a cross-section diagram of the structure of a portion of a pixel column in which consecutive pixel rows share a common select electrode.
Figure 5A:
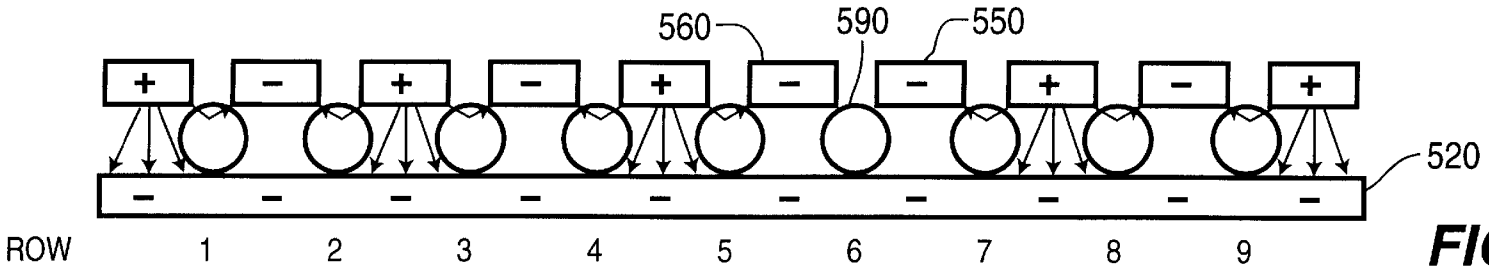
FIGS. 5(*a*)–5(*d*) are operational diagrams that are helpful in understanding the operation of the portion of a pixel column shown in FIG. 4.
Figure 5B:
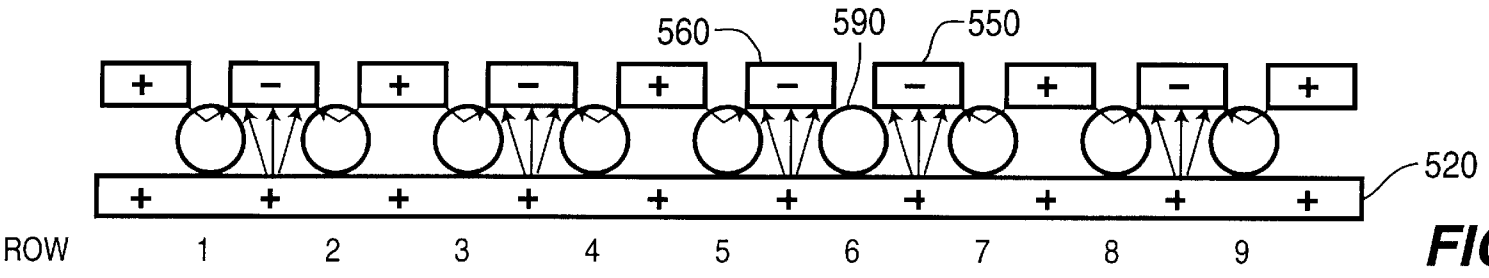
Figure 5C:
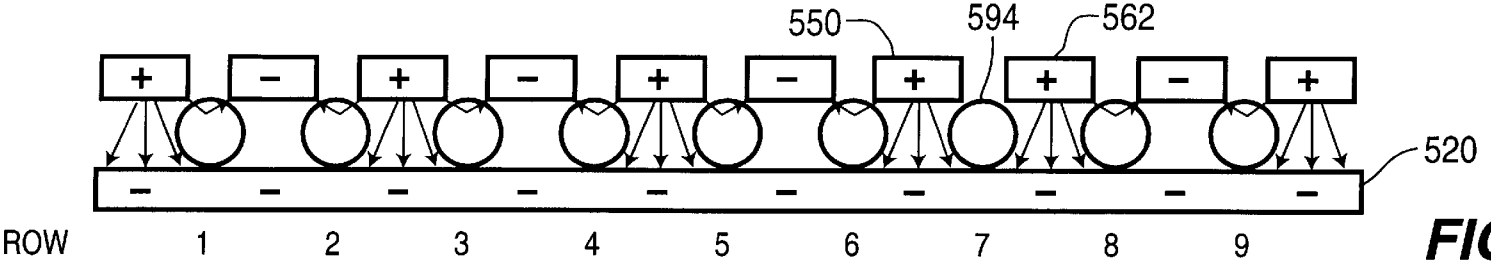
Figure 5D:
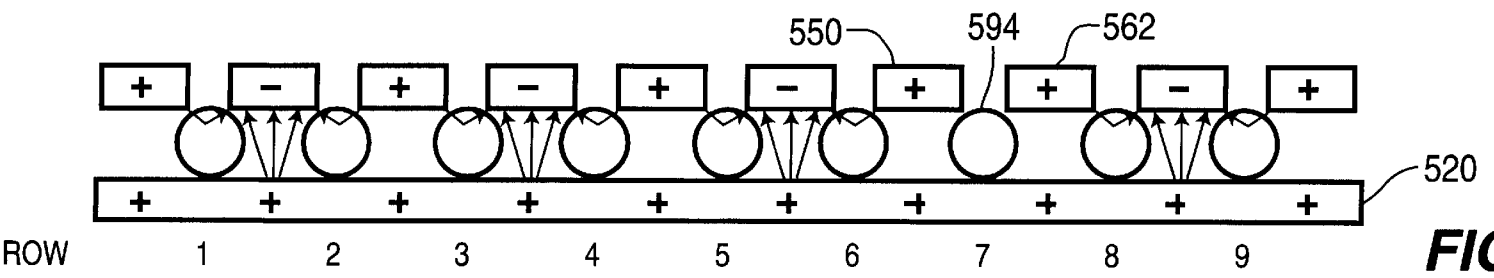

FIG. 4 is a cross-section diagram of the structure of a portion of a pixel column in which consecutive pixel rows share a common select electrode. FIG. 4 shows the cross section of three pixel rows having a common data electrode 420, and select electrodes 450, 460, 452, and 462. Each pixel includes a plasma gas microcapsule, 490, 492, and 494, respectively. The gas microcapsules are all positioned between top substrate 410 and bottom substrate 470. Associated with each pixel is a phosphor, 404, 406, and 408, respectively. The phosphors may correspond, for example, to the colors red, green, and blue. In the arrangement of FIG. 4 adjacent rows of pixels share a common electrode. For example, select electrode 450 is shared by the first and second pixel rows, and select electrode 462 is shared by the second and third pixel rows. In other words, a select electrode is shared by a pixel row to the right of the electrode and to the left of the electrode. In this manner high electrical fields are not generated, as in the arrangement of FIG. 3, between the select electrode of one pixel row and the select electrode of the adjacent pixel row.

Configurations such as those shown in FIGS. 3 and 4 may be used with or without the plasma gas microcapsules. When plasma gas is contained within gas microcapsules, however, the need to seal the display against gas leaks is alleviated. Further, the microcapsules reduce the need to insulate the electrodes preventing active plasma from coming into contact with the phosphors. The use of microcapsules may also help to localize pixels and prevent unwanted plasma migration from one pixel to another. Therefore, the use of microcapsules may facilitate the design of large area, physically flexible PDPs.

Microcapsules may be formed, for example, by transparent microspheres or microtubes. A microsphere may be associated with a single pixel, or alternatively, a microtube may be associated with an entire pixel row, a portion of a pixel row, an entire pixel column, or a portion of a pixel column.

FIGS. 5(*a*)–5(*d*) show different states of operation of a display, for a portion of exemplary pixel columns, each containing nine pixel rows. All the pixels in the column, numbered one through nine, are shown sharing a common data electrode 520. Consecutive pixel rows are shown sharing a common select electrode. For example, rows five and six share select electrode 560, rows six and seven share select electrode 550, and rows seven and eight share select electrode 562. Electrodes in FIGS. 5(*a*)–5(*d*) are labeled with + and −signs, where +indicates one phase and −indicates a second phase.

Alternating phase voltages may be applied to each select electrode except those adjacent to (i.e. to the left of or to the right of) a particular row of pixels that is selected for writing. Thus, all pixels in a pixel row are in a sustain state except for those selected for writing. For example, in FIGS. 5(*a*) and 5(*b*) pixel row six is selected for writing by setting the signals applied to select electrodes 560 and 550 to the voltage phase indicated by the −signs, while in FIGS. 5(*c*) and 5(*d*) pixel row seven is selected for writing by setting select electrodes 550 and 562 to the voltage phase indicated by the +signs. In other words, the signals applied to the select electrodes, to the left and to the right, of each selected pixel row are in phase. FIGS. 5(*a*) and 5(*b*) show pixel rows one through five and pixel rows seven through nine unselected. FIGS. 5(*c*) and 5(*d*) show pixel rows one through six and pixel rows eight and nine unselected. In other words, the signals applied to the select electrodes, to the left and to the right, of each of the unselected pixel rows are 180° out of phase, as indicated by the alternating +signs and −signs.

Once a pixel row has been selected for writing, the state of the selected pixel row is determined by the phase of the signal applied to the data electrode. For example, in FIG. 5(*a*) pixel row six alone is selected for writing, and an OFF state is written into selected pixel 590, as the phase of selected electrodes 560 and 550 (−voltage phase), matches that of data electrode 520. In contrast, FIG. 5(*b*) shows an ON state being written into selected pixel 590, as the data electrode (+voltage phase) is out of phase with select electrodes 560 and 550 (−voltage phase). In FIG. 5(*c*) pixel row seven alone is selected for writing, and an ON state is written into selected pixel 594, as the data electrode (−voltage phase) is out of phase with select electrodes 562 and 550 (+voltage phase). In contrast, FIG. 5(*d*) shows an OFF state written into selected pixel 594, as the phase of selected electrodes 562 and 550 (+voltage phase), matches that of data electrode 520.

An unselected pixel row may be selected by inverting the phase of the signal applied to the select electrode to the left of that row; i.e. the select electrode that the unselected row shares with the selected row. This places the previously selected row into a sustain state and the newly selected (or addressed) row into a write state. It may be observed in FIGS. 5(*a*)–5(*d*) that a write state may be propagated from left to right in the pixel column by inverting the phase of the select electrodes, to the left of each pixel, one at a time. For example, suppose an ON state has been written into pixel 590 as in FIG. 5(*b*), inverting the phase of the signal applied to select electrode 550 (from a −voltage phase to a +voltage phase) deselects pixel 590, and places pixel 590 into a sustain state. Simultaneous with the deselection of pixel 590 is the selection of pixel 594, as shown in FIG. 5(*d*). In this case, the phase of the signal applied to data electrode 520 remains unchanged and an OFF state will be written into pixel 594. Moreover, the inversion of the phase of the signal applied to select electrode 550 does not affect the states of any pixel rows other than row six and row seven. Using this configuration and addressing scheme allows for a previously addressed field to continue to operate while the first row of a new field is addressed. A new field may be addressed by inverting the phase of the signal applied to the first select electrode (i.e. the select electrode to the left of the first pixel row).

Propagating a write state down the column (from left to right in FIGS. 5(*a*)–5(*d*)) to load a new field may be accomplished, as explained above, by inverting one by one, the phase of the signal applied to each of the first select electrode of each pixel row (i.e. the select electrode to the left of each pixel row). Using this scheme, suppose that a pixel is selected while loading one field, by inverting the phase of the signal applied to the first select electrode from a first phase (e.g. a +voltage phase) to a second phase (e.g. a −voltage phase), as for pixel 590 in FIG. 5. The same pixel would be selected while loading the next successive field by inverting the phase of the signal applied to the first select electrode from a second phase (e.g. a −voltage phase) to a first phase (e.g. a +voltage phase), as for pixel 594 in FIG. 5. For example, when loading one field the addressing phases of a column, such as that shown in FIG. 5, are changed from (+,−,+,−,+,−+,−,+,−) to (−,−,+,−,+,−,+,−,+,−) (selecting the first pixel row), and finally to (−,+,−,+,−,+,−,+,−,+) once the write state had propagated down the column. While when loading the successive filed, the addressing phases of a column, such as that shown in FIG. 5 are changed from (−,+,−,+,−,+,−,+,−,+) to (+,+,−,+,−,+,−,+,−,+) (selecting the first pixel row), and finally to (+,−,+,−,+,−,+,−,+,−) once the write state had propagated down the column.

In this case, while loading the one field, an ON state may be written to the selected pixel, by setting the phase applied to the data electrode to the first phase (see FIG. 5(*b*)), and an OFF state may be written by setting the phase applied to the data electrode to the second phase (see FIG. 5(*a*)). While when loading the successive field, an ON state may be written to the selected pixel, by setting the phase applied to the data electrode to the second phase (see FIG. 5(*c*)), and an OFF state may be written by setting the phase applied to the data electrode to the first phase (see FIG. 5(*d*)).

Conversely, suppose that a pixel is selected while loading one field, by inverting the phase of the signal applied to the first select electrode from a second phase (e.g. a −voltage phase) to a first phase (e.g. a +voltage phase), as for pixel 594 in FIG. 5. Then the same pixel would be selected while loading the successive field by inverting the phase of the signal applied to the first select electrode from a first phase (e.g. a +voltage phase) to a second phase (e.g. a −voltage phase), as for pixel 590 in FIG. 5. In this case, while loading the one field, an ON state may be written to the selected pixel, by setting the phase applied to the data electrode to the second phase (see FIG. 5(*c*)), and an OFF state may be written by setting the phase applied to the data electrode to the first phase (see FIG. 5(*d*)). While when loading the next successive field, an ON state may be written to the selected pixel, by setting the phase applied to the data electrode to the first phase (see FIG. 5(*b*)), and an OFF state may be written by setting the phase applied to the data electrode to the second phase (see FIG. 5(*a*)).

Figure 6:
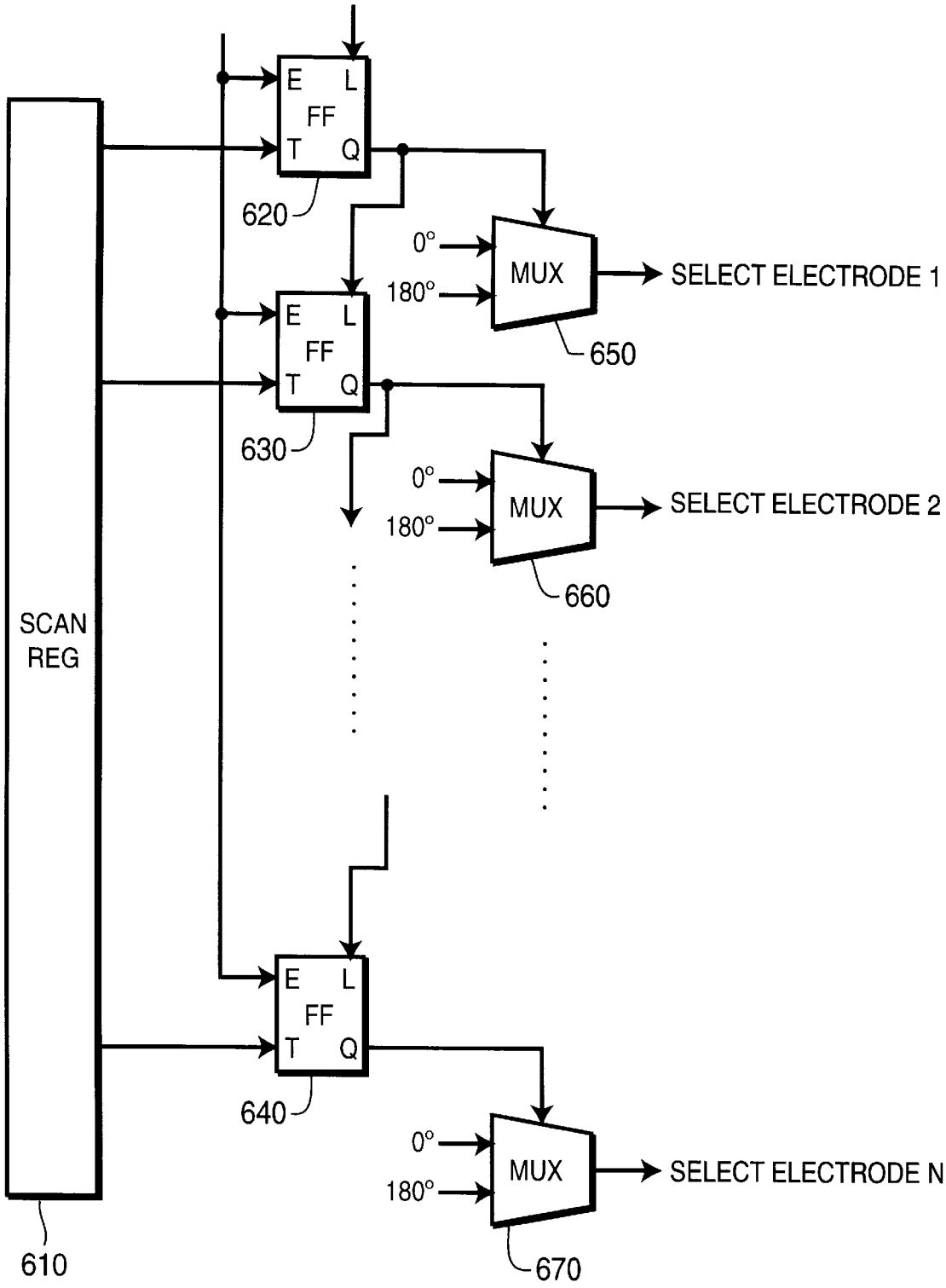
FIG. 6 is a block diagram of a digital circuit that is helpful in understanding the switching operation of the select electrodes in accordance with an embodiment of the present invention.

The method of addressing a display described in the foregoing may be implemented by a digital circuit. An exemplary digital circuit for controlling the switching operation of select electrodes corresponding to N pixel rows in a pixel column is shown in FIG. 6. The diagram of FIG. 6 includes: scan register 610; toggle (T) flip-flops (with external load) 620, 630, and 640; and 2×1 multiplexers 650, 660, and 670. The flip-flops may be connected in series—output Q to external load input L—and may share control input E. Initially, an alternating sequence of 0's (or logic-lows) and 1's (or logic-highs) may be loaded into flip-flops 620, 630, and 640 by alternating logic-highs and logic-lows on the external load line (or L input) of first flip-flop 620. Enable input E of shared by flip-flops 620, 630, and 640 may be used to arbitrate between external input L and toggle input T. External setting of output Q occurs on an edge transition (e.g. positive going) of control input E, and toggles of output Q occur on an edge transition of toggle input T.

Each of N 2×1 multiplexers switch between an AC signal at the reference phase of $\bar{\phi}=0°$ and the AC signal at the complementary phase of $\bar{\phi}=180°$. The output signals Q of the flip-flops may be used to control the switching operation as shown in FIG. 6. Each of the outputs of the multiplexers (i.e. the AC signal at phase $\phi=0°$ or phase $\bar{\phi}=180°$) is connected to a select electrode. In FIG. 6 the label "select electrode i", refers to the select electrode to the left of the $i^{th}$ row. Thus, when an alternating sequence of 1's and 0's is loaded into the flip-flops, adjacent select electrode are supplied with signals alternating between the reference phase and the complementary phase. The alternating phases place the entire column into a sustain state. A write state may then be propagated down a pixel column by shifting a logic-high through scan register 610. A logic-high loaded into the first location of scan register 610 toggles first flip-flop 620 and hence switches the phase of the signal applied to the first select electrode to be the same as that applied to the second select electrode, thus placing the first pixel row into a write state. The remaining pixel rows may then be selected one at a time by shifting the logic-high through scan register 610, toggling the flip-flops, and switching the phases of the signals applied to the select electrodes one by one.

Figure 7A:
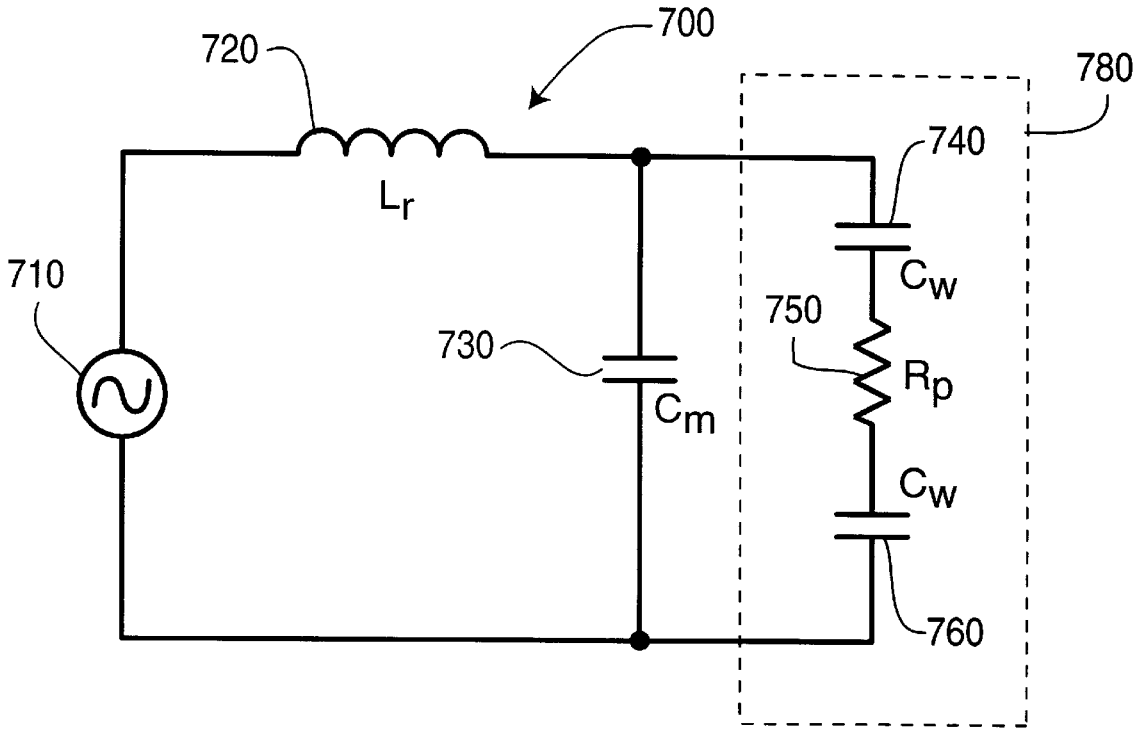
FIG. 7(*a*) is a simplified circuit diagram modeling a plasma display panel in accordance with an embodiment of the present invention.
Figure 7B:
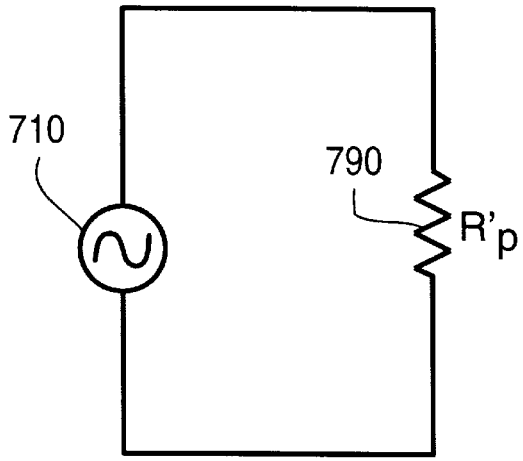

In order to efficiently deliver energy to the gas plasma of the display panel, an external inductor and an external capacitor may be added to set the impedance of the display panel to be purely resistive at the operating frequency. FIG. 7(*a*) shows a circuit diagram that includes: signal source 710 for supplying an AC signal, external inductor ($L_r$) 720, external capacitor ($C_m$) 730, and a simplified model for a PDP 780. Simplified circuit model 780 includes: plasma sheath capacitances 740 and 760, and plasma resistance 750. Inductance $L_r$ of external inductor 720, and capacitance 730 of external capacitor 730 may be tuned for resonance coupling. In this case, at the operating frequency of signal source 710 (e.g. 5 MHz), circuit 700 of FIG. 7(*a*) is equivalent to the resistive circuit shown in FIG. 7(*b*). The circuit shown in FIG. 7(*b*) includes signal source 710 and equivalent resistor ($R'_p$) 790.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed:

1. A display apparatus having a plurality of pixels, each pixel having an ON state and an OFF state, each pixel of the display apparatus comprising:

a top substrate;

a bottom substrate disposed parallel to the top substrate;

a first select electrode provided on one of the top substrate and the bottom substrate;

a second select electrode, adjacent to the first select electrode, provided on the same substrate;

a data electrode provided on the opposite substrate;

a source of alternating current (AC) signal having first and second phases;

a first switch connected to the source of AC signal and to the first select electrode for selectively applying the first phase or the second phase of the AC signal to the first select electrode;

a second switch connected to the source of AC signal and to the second select electrode for selectively applying the first phase or the second phase of the AC signal to the second select electrode; and a third switch connected to the source of AC signal and to the data electrode for selectively applying the first phase or the second phase of the AC signal to the data electrode, wherein, when the same phase is applied to both the first and second select electrodes, the phase of the AC signal applied to the data electrode determines the state of the pixel and when the phase applied to the first select electrode differs from the phase applied to the second select electrode the state of the pixel remains unchanged.

2. The display of claim 1, wherein each pixel of the plurality of pixels further comprises a gas capsule, formed by a tube transparent to ultra violet (UV) light, interposed between the top substrate and the bottom substrate and aligned with the first select electrode and the second select electrode.

3. The display of claim 1, wherein each pixel of the plurality of pixels further comprises a gas capsule, formed by a sphere transparent to ultra violet (UV) light , interposed between the top substrate and the bottom substrate and aligned with the first select electrode and the second select electrode.

4. The display of claim 1, wherein a first dielectric layer is formed on the top substrate, and a second dielectric layer is formed on the bottom substrate.

5. The display of claim 1, wherein at least one of the top substrate and the bottom substrate are formed from a transparent material.

6. The display of claim 4, wherein the second dielectric layer is thicker than the first dielectric layer.

7. A display apparatus comprising:

a top substrate;

a bottom substrate disposed parallel to the top substrate;

a first select electrode provided on one of the top substrate and the bottom substrate;

a second select electrode, adjacent to the first select electrode, provided on the same substrate;

a data electrode provided on the opposite substrate;

a gas capsule interposed between the top substrate and the bottom substrate and aligned with the first select electrode and the second select electrode; and a signal generator for generating a first select signal applied to the first select electrode, at a predetermined frequency, a second select signal applied to the second select electrode, at the predetermined frequency, having a first phase relationship with respect to the first select signal, and a data signal applied to the data electrode, at the predetermined frequency, having a second phase relationship with respect to the first select signal.

8. The display of claim 7, wherein the gas capsule is formed by a transparent tube.

9. The display of claim 7, wherein the gas capsule is formed by a transparent sphere.

10. The display of claim 7, wherein a first dielectric layer is formed on the top substrate, and a second dielectric layer is formed on the bottom substrate.

11. The display of claim 7, wherein at least one of the top substrate and the bottom substrate is formed from a transparent material.

12. The display of claim 10, wherein the second dielectric layer is thicker than the first dielectric layer.

13. A method of addressing a plasma display having a plurality of pixels, said method comprising the steps of:

generating a data signal;

associating each of the plurality of pixels with a respective left select signal and a respective right select signal;

selecting one pixel of the plurality of pixels by setting the respective left select signal to be in phase with the respective right select signal;

writing an ON to the selected pixel by setting the data signal to be out of phase with the respective left select signal and the respective right select signal;

writing an OFF to the selected pixel by setting the data signal to be in phase with the respective left select signal and the respective right select signal; and deselecting the pixel by setting the respective left select signal to be out of phase with the respective right select signal.

14. A display apparatus comprising:

a plurality of pixels, each pixel having an ON state and an OFF state, each pixel of the display including:

(a) a first select electrode for receiving a left select signal, (b) a second select electrode, disposed adjacent to the first select electrode, for receiving a right select signal, (c) a data electrode, disposed parallel to the first select electrode and the second select electrode, for receiving a data signal, and (d) gas interposed between the data electrode and the first and second select electrodes;

select means for selecting at least one pixel of the plurality of pixels; and writing means for writing an ON state to the selected pixel of the plurality of pixels by setting the left select signal to be in phase with the right select signal, and setting the data signal to be out of phase with the left select signal and the right select signal, and writing an OFF state to the selected pixel by setting the data signal to be in phase with left select signal and the right select signal.

15. A display apparatus comprising:

a plurality of pixel columns, each pixel column having a data electrode for applying a data signal to a plurality of successive pixels, each pixel having an ON state and an OFF state, each pixel including:

(a) a first select electrode for receiving a left select signal, and (b) a second select electrode, disposed adjacent to the first select electrode, for receiving a right select signal, wherein the second select electrode of one pixel of the plurality of successive pixels is the first select electrode of another successive pixel of the plurality of pixels;

select means for selecting a pixel of the plurality of successive pixels; and writing means for writing an ON state to the selected pixel of the plurality of pixels by setting the left select signal to be in phase with the right select signal, and setting the data signal to be out of phase with the left select signal and the right select signal, and writing an OFF state to the selected pixel by setting the data signal to be in phase with left select signal and the right select signal.

16. A display apparatus comprising:

a source of alternating current (AC) signal having first and second phases;

a plurality of pixel columns, each pixel column having a data electrode for applying a data signal to a plurality of successive pixels, each pixel having an ON state and an OFF state, each pixel including:

(a) a first select electrode for receiving a left select signal, and (b) a second select electrode, disposed adjacent to the first select electrode, for receiving a right select signal, wherein the second select electrode of one pixel of the plurality of successive pixels is the first select electrode of another successive pixel of the plurality of pixels;

select means for selecting a pixel of the plurality of successive pixels by setting both the left select signal and the right select signal to one of the first phase and the second phase; and writing means for writing an ON state to the selected pixel of the plurality of pixels by setting the data signal to the second phase if both the left select signal and the right select signal are set to the first phase, and by setting the data signal to the first phase if both the left select signal and the right select signal are set to the second phase, and writing an OFF state to the selected pixel by setting the data signal to the first phase if both the left select signal and the right select signal are set to the first phase, and by setting the data signal to the second phase if both the right select signal and the left select signal are set to the second phase.

17. A display apparatus having a plurality of pixels, each pixel having an ON state and an OFF state, each pixel of the display apparatus comprising:

a source of alternating current (AC) signal having a reference phase and a complementary phase;

a top substrate;

a bottom substrate disposed parallel to the top substrate;

a reference electrode, provided on the bottom substrate, receiving the reference phase of the AC signal;

a select electrode, adjacent to the reference electrode, provided on the bottom substrate;

a data electrode provided on the top substrate;

a first switch connected to the source of AC signal and to the second select electrode for selectively applying the reference phase or the complementary phase of the AC signal to the select electrode; and a second switch connected to the source of AC signal and to the data electrode for selectively applying the reference phase or the complementary phase of the AC signal to the data electrode, wherein when the reference phase is applied to the select electrode the pixel is set to the ON state if the complementary phase is applied to the data electrode and the pixel is set to the OFF state if the reference phase is applied to the data electrode, when the complementary phase is applied to the select electrode the state of the pixel remains unchanged.

* * * * *